US005138934A

United States Patent [19]

Murayama et al.

[11] Patent Number: 5,138,934

[45] Date of Patent: Aug. 18, 1992

[54] CYLINDER WITH A BUILT-IN STROKE SENSOR HAVING AN ECCENTRIC MEMBER

[75] Inventors: Osamu Murayama, Hiratsuka; Yoshiyuki Hirosawa, Komatsu; Nobuyuki Nagahashi, Atsugi, all of Japan

[73] Assignee: Kabushiki Kaisha Komatsu Seisakusho, Tokyo, Japan

[21] Appl. No.: 678,333

[22] PCT Filed: Aug. 31, 1990

[86] PCT No.: PCT/JP90/01121

§ 371 Date: Apr. 26, 1991

§ 102(e) Date: Apr. 26, 1991

[87] PCT Pub. No.: WO91/03652

PCT Pub. Date: Mar. 21, 1991

[30] Foreign Application Priority Data

Aug. 31, 1989 [JP] Japan ..... 1-102587

[51] Int. Cl.[5] ..... F15B 15/28

[52] U.S. Cl. ..... 92/5 R; 324/207.23

[58] Field of Search ..... 92/5 R; 91/1, DIG. 4; 324/207.22, 207.23, 207.13

[56] References Cited

U.S. PATENT DOCUMENTS

| | | | |
|---|---|---|---|
| 4,386,552 | 6/1983 | Foxwell | 91/1 |
| 4,656,457 | 4/1987 | Brausfeld et al. | 92/5 R X |
| 4,719,419 | 1/1988 | Dawley | 324/207.22 |
| 4,889,035 | 12/1989 | Goodnow | 91/DIG. 4 X |
| 4,912,409 | 3/1990 | Redlich et al. | 324/207.13 |

FOREIGN PATENT DOCUMENTS

| | | |
|---|---|---|
| 3116333 | 11/1982 | Fed. Rep. of Germany . |
| 3123572 | 12/1982 | Fed. Rep. of Germany . |
| 123494 | 10/1976 | Japan . |
| 106209 | 8/1981 | Japan . |
| 164803 | 10/1986 | Japan . |
| 25304 | 2/1988 | Japan . |

*Primary Examiner*—Edward K. Look
*Assistant Examiner*—John Ryznic
*Attorney, Agent, or Firm*—Richards, Medlock & Andrews

[57] ABSTRACT

A cylinder with a built-in stroke sensor which is mounted in a machine or apparatus such as a construction machine used in a severe environment, and which is designed so as to minimize the stroke sensor accommodation space and to make inspection and replacement of the stroke sensor rod easier. An eccentric member is attached to an end of a sensor rod, a recess/projection coaxial with the sensor rod is provided at the center of this member, a projection/recess axially supported by a recess/projection provided at the center of an end surface of the a head is provided at an end of this member, and a ring-like member engaging with the recess/projection of the eccentric member is mounted in the cavity of the piston rod. The arrangement may alternatively be such that a projection/recess axially supported by a recess/projection provided at the center of an end surface of a bottom is provided at an end of the eccentric member, and that a ring-like member engaging with the recess/projection of the eccentric member is mounted in the cavity of the cylinder.

23 Claims, 5 Drawing Sheets

CYLINDER WITH A BUILT-IN STROKE SENSOR HAVING AN ECCENTRIC MEMBER

TECHNICAL FIELD

This invention relates to a cylinder with a built-in stroke sensor. More particularly, the invention relates to a cylinder with a built-in stroke sensor mounted in a machine or apparatus such as a construction machine used in a severe environment.

BACKGROUND ART

Various working machine control devices have been proposed for the purpose of making the operations of construction machines or the like easier and to reduce burdens on operators. As one of such devices, a hydraulic cylinder has been proposed which is used for each section of a working machine, whose operating stroke is detected, and to which a hydraulic cylinder operating stroke sensor is attached. This hydraulic cylinder includes a type having a built in stroke sensor provided in its central portion to be protected from earth, sand, muddy water and the like.

FIGS. 7 and 8 are cross-sectional views of head portions of cylinders with built-in stroke sensors in accordance with the prior art wherein a sensor accommodation tube 7 is provided in a cavity provided at the bottom of a fluid pressure cylinder and at the center of a piston rod 2, and wherein a stroke sensor using a potentiometer or the like is provided in the sensor accommodation tube 7.

The stroke sensor is composed of a sensor body 5 having a resistor, and a sensor rod 6 having a brush which slides on the surface of the resistor. An end of the sensor body 5 is supported on the unillustrated bottom, and an end of the sensor rod 6 is attached by screwing with nuts 14 and 15 to a plate 24 fitted to the piston rod 2 at an end of the cavity thereof. A rod head 3 is fixed to an end of the piston rod 2.

As fluid pressure is produced for action in the cylinder 1 so that the piston rod 2 is moved reciprocatively, the sensor rod 6 of the stroke sensor is also moved with the movement of the piston rod 2, the brush sliding on the resistor electrically detects a voltage value of the resistor, and this value is supplied to a controller through an electric wiring.

If a rotary motion of the piston rod 2 in a circumferential direction is allowed as well as the axial reciprocating motion when this fluid pressure cylinder is operated, a structure is required in which the stroke sensor is attached while the sensor rod 6 is made concentric with the piston rod 2, and in which the sensor rod 6 is freely rotatable relative to the brush. To reduce the outside diameter of the sensor body 5*a*, it is necessary to make the the sensor rod 6 eccentric to the sensor body 5*a* and to limit the direction in which the brush faces to one direction.

In the case of the stroke sensor used as shown in FIG. 7 where the center of the sensor body 5 and the center of the sensor rod 6 coincide with each other, the outside diameter of the sensor body 5 is large in comparison with the stroke sensor shown in FIG. 8 in which the sensor rod 6 is eccentric to the sensor body 5*a*. In the case of the stroke sensor shown in FIG. 8, where the sensor rod 6 is eccentric to the sensor body 5*a*, the outside diameter of the sensor body 5*a* is reduced but it is necessary to select a large inside diameter of the sensor accommodation tube 7 as in the case of FIG. 7 because it is necessary that the center of the piston rod 2 and the center of the sensor rod 6 coincide with each other. Consequently, in either case of FIGS. 7 and 8, the arrangement is disadvantageous in that the stroke sensor accommodation space is increased so that the size of the fluid pressure cylinder is large and so that the manufacture cost is high. It is also disadvantageous in that the operating oil for the reciprocating motion of the piston rod 2 is spattered on the sensor at the time of inspection or replacement of the sensor body 5, and that since the cylinder bottom of the conventional type cylinders is of an integral type, the operation for inspection or replacement of the stroke sensor is laborious and entails a leak of the operating oil.

In consideration of these problems, it is an object of the present invention to provide a cylinder with a built-in stroke sensor which has a structure such that the stroke sensor accommodation space can be minimized, and whose stroke sensor can be inspected or replaced easily.

DISCLOSURE OF INVENTION

A fluid pressure cylinder with a built-in stroke sensor in accordance with the present invention includes a cylinder having a bottom at its one end, a tubular piston rod reciprocatively movable in the cylinder and having a rod head at its one end, and the stroke sensor constituted by a sensor body and a sensor rod and provided in the cavity of the piston rod, wherein an eccentric member is attached to an end of the sensor rod, a recess/projection coaxial with the sensor rod is provided at the center of this member, a projection/recess axially supported by a recess/projection provided at the center of an end surface of the rod head is provided at an end of this member, and a ring-like member engaging with the recess/projection of the eccentric member is mounted in the cavity of the piston rod.

The arrangement may alternatively be such that a projection/recess axially supported by a recess/projection provided at the center of an end surface of the bottom is provided at an end of the eccentric member, and that a ring like member engaging with the recess/projection of the eccentric member is mounted in the cavity of the cylinder.

Further, a seal for preventing an operating fluid for reciprocatively moving the piston rod from being spattered on the sensor body 5 is provided between an inner end portion of the cylinder and an inner end portion of the piston rod.

In accordance with this arrangement, the ring-like member engaging with the recess/projection of the eccentric member restrains the sensor rod of the stroke sensor so as to inhibit an axial movement of the same different from the movement of the piston rod. Accordingly, in a case where the sensor rod is engaged and held on the piston rod side, as the piston rod is reciprocatively moved while rotating, the ring-like member slides on the eccentric member while engaging with the same, the stroke sensor is not rotated, and the stroke of the reciprocating movement of the piston rod can be detected.

In a case where the sensor rod is engaged and held on the cylinder bottom side, as the piston rod is reciprocatively moved while rotating, the stroke sensor simultaneously extends or retracts and rotates, and the eccentric member slides on the ring-like member while engaging with the same, no excessive force being applied to the stroke sensor, the stroke sensor is not rotated. The stroke of the reciprocating movement of the piston rod can be detected.

In either case, the stroke sensor accommodation space can be remarkably reduced as compared with the prior art.

Further, the operating fluid is not spattered on the sensor body since the seal is provided, and the stroke sensor can easily be inspected or replaced because the cylinder bottom is designed as a separable type. At the time of inspection of replacement, there is no risk of the operating fluid leaking out.

BRIEF DESCRIPTION OF DRAWINGS

FIG. 6(*a*) is a front sectional view;

FIG. 6(*b*) is a cross-sectional view taken along the line A—A of FIG. 6(*a*);

FIG. 7 shows a cylinder with a built-in stroke sensor in which a sensor body and a sensor rod are disposed coaxially; and FIG. 8 shows a cylinder with a built-in stroke sensor in which a sensor rod is eccentric to a sensor body.

BEST MODE FOR CARRYING OUT THE INVENTION

Embodiments of cylinders with built-in stroke sensors in accordance with the present invention will be described below in detail with reference to the accompanying drawings.

Figure 1:
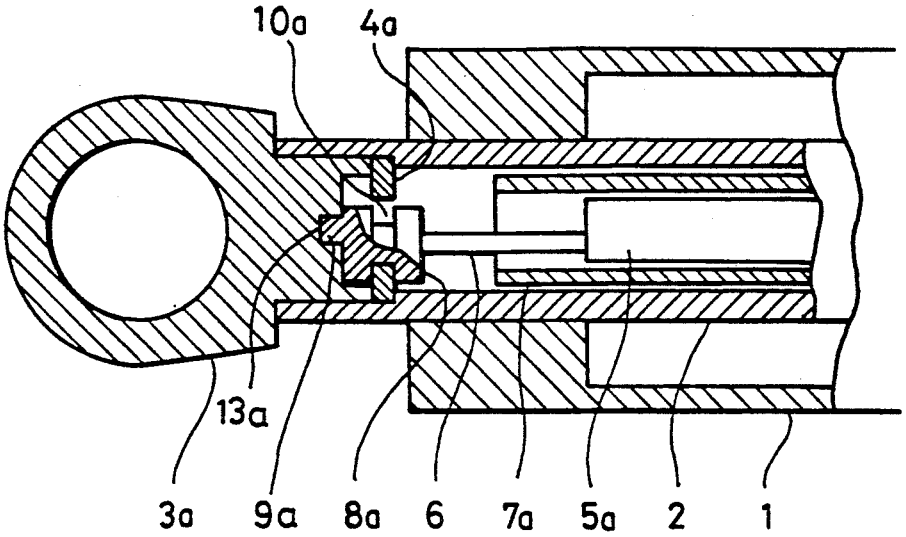
FIGS. 1 to 4 are cross-sectional views of head portions of cylinders with built-in stroke sensors in accordance with first to fourth embodiments of the present invention.

FIGS. 1 to 4 are cross-sectional views of head portions of fluid pressure cylinders. Referring to FIG. 1, a piston rod 2 moved reciprocatively in a cylinder 1 has a tubular form, and a boss portion of a rod head 3*a* and a ring-like member 4*a* are fitted in the cavity at one end thereof and are connected to the piston rod 2. A stroke sensor having sensor rod 6 eccentric to a sensor body 5*a* is placed together with a sensor accommodation tube 7*a* in the cavity of the piston rod 2.

An eccentric member 8*a* is fixed to an extreme end of the sensor rod 6. The eccentric member 8*a* has a projection 9*a* provided at its extreme end, and a groove 10*a* provided at its center, the groove 10*a* being coaxial with the sensor rod 6. The projection 9*a* has an eccentricity to the center of the eccentric member 8*a*. This eccentricity is equal to that between the sensor body 5*a* and the sensor rod 6. The projection 9*a* is rotatably fitted in a recess 13*a* formed in an end surface of the boss portion of the rod head 3*a*. The ring-like member 4*a* is partially engaged with the groove 10*a* of the eccentric member 8*a*, and gaps for enabling smooth sliding are formed between two side surfaces of the ring-like member 4*a* and two side surfaces of the groove 10*a*.

As fluid pressure is produced for action in the cylinder 1 so that the piston rod 2 is forced in or out while rotating, the ring like member 4*a* is maintained in the state of engaging with the eccentric member 8*a* while sliding on the side surfaces of the groove 10*a* of the eccentric member 8*a*. The sensor rod 6 therefore moves in the axial direction alone by following the reciprocating motion of the piston rod 2 without rotating although the piston rod 2 is rotated, thereby detecting the cylinder stroke.

Figure 2:
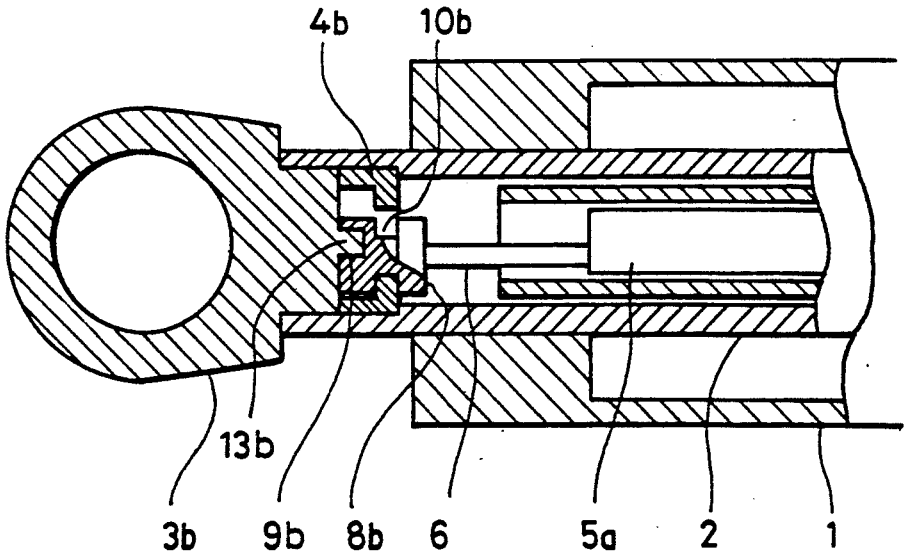

FIG. 2 shows the second embodiment of the present invention in which a projection 13*b* is provided on an end surface of a boss portion of a rod head 3*b* at the center thereof and is rotatably fitted in a recess 9*b* formed in an end surface of an eccentric member 8*b*. The recess 9*b* has an eccentricity to the center of the eccentric member 8*b*. This eccentricity is equal to that between the sensor body 5*a* and the sensor rod 6. A ring-like member 4*b* is partially engaged with a groove 10*b* having a ] -shaped cross sectional configuration and formed on the eccentric member 8*b* at the center, and gaps for enabling smooth sliding are formed between engaging surfaces of the ring-like member 4*b* and two side surfaces of the groove 10*b*.

Figure 3:
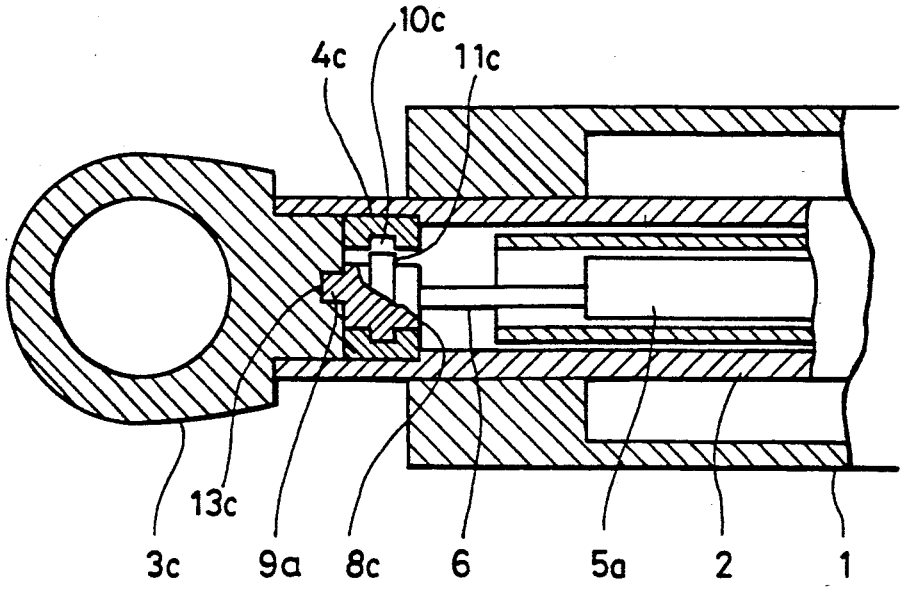

FIG. 3 shows the third embodiment of the present invention in which an eccentric member 8*c* has a projection 9*c* provided at its extreme end, and a flange 11*c* provided at its center. The projection 9*c* has an eccentricity to the center of the eccentric member 8*c*. This eccentricity is equal to that between the sensor body 5*a* and the sensor rod 6. The projection 9*c* is rotatably fitted in a recess 3*c* formed in an end surface of the rod head 3*c* at the center thereof. A groove 10*c* partially engaged with the flange 11*c* of the eccentric member 8*c* is provided in the ringlike member 4*c* at the center.

Figure 4:
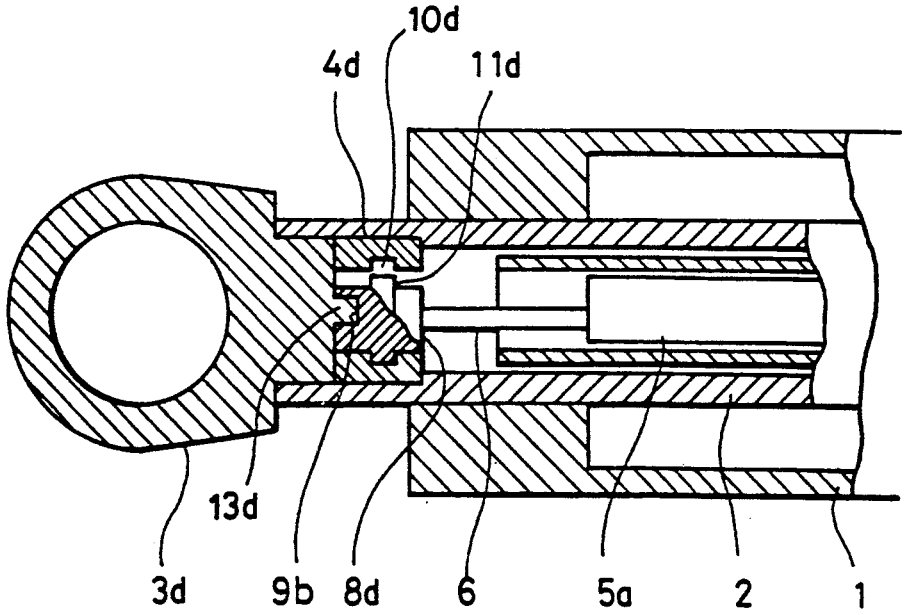

FIG. 4 shows the fourth embodiment of the present invention in which a projection 13*d* is provided on an end surface of a boss portion of a rod head 3*d* at the center thereof and is rotatably fitted in a recess 9*d* formed in an end surface of an eccentric member 8*d* and having an eccentricity to the center of the eccentric member 8*d*. This eccentricity is equal to that between the sensor body 5*a* and the sensor rod 6. A flange 11*d* is provided on the eccentric member 8*d* at the center, and a groove 10*d* partially engaged with the flange 11*d* of the eccentric member 8*d* is provided in the ring-like member 4*d* at the center.

The interrelation between the eccentric member 8*b–d* and the ring-like member 4*b–d* during the reciprocating motion of the piston rod in the second to fourth embodiments is the same as the first embodiment, the description for it will not be repeated.

Figure 5:
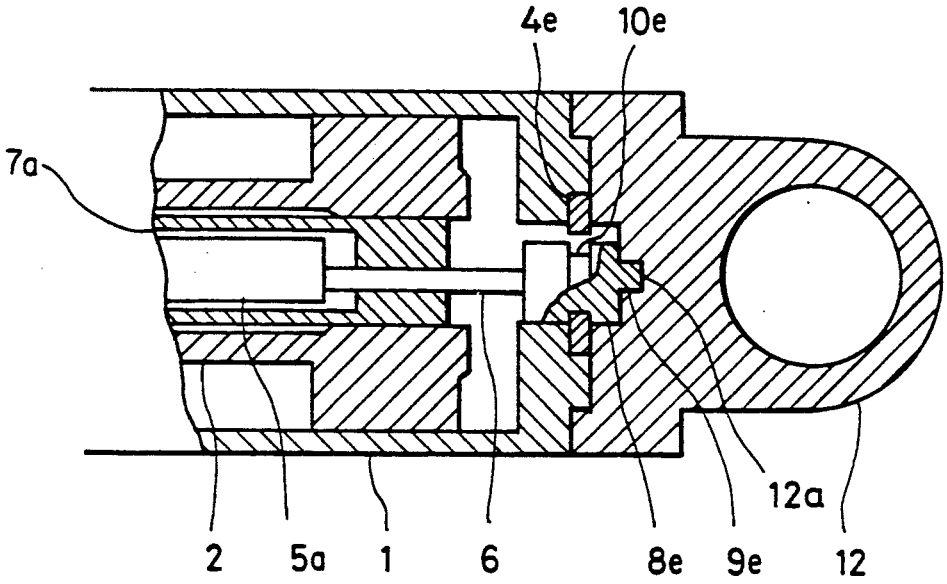
FIG. 5 is a cross-sectional view of a bottom portion of a cylinder with a built-in stroke sensor in accordance with a fifth embodiment of the present invention.

FIG. 5 shows a fifth embodiment of the present invention, showing a state in which an end of the sensor rod 6 of the stroke sensor is engaged at a bottom 12 of the fluid pressure cylinder. A projection 9*c* of an eccentric member 8*e*, fixed to the end of the sensor rod 6, is rotatably fitted in a recess 12*a* formed at the center of the bottom 12. The projection 9*e* has an eccentricity to the center of the eccentric member 8*e*. This eccentricity is equal to that between the sensor body 5*a* and the sensor rod 6. A ring-like member 4*e* is pinched between the bottom 12 and the cylinder 1 and is partially engaged with a groove 10*c* of the eccentric member 8*e*, and gaps for enabling smooth sliding are formed between engagement surfaces of the ring-like member 4*e* and two side surfaces of the groove 10*e*.

As fluid pressure is produced for action in the cylinder 1 so that the piston rod 2 is forced in or out while rotating, the stroke sensor having the end of the sensor body 5*a* fixed to the piston rod 2 is also rotated. At this time, the sensor rod 6 is rotated together with the sensor body 5*a*, and the eccentric member 8*e* has side surface portions of its groove 10 sliding on the side surfaces of the ring-like member 4*e* while being maintained in the state of engaging with the ring-like member 4*e*. Thus the stroke sensor moves in accordance with the motion of the piston rod 2, i.e., the reciprocating motion and the rotary motion, thereby detecting the cylinder stroke.

With respect to this embodiment, only an example of the engagement of the extreme end of the sensor rod 6 on the bottom 12 side of the fluid pressure cylinder (the inverse of the structure of the first embodiment shown in FIG. 1) has been explained. However, this is not exclusive, and other structures may also be adopted in which, as in the case of the examples shown in FIGS. 2 to 4, a recess formed at an end of an eccentric member is rotatably fitted to a projection formed at the center of a bottom, while a flange provided at the center of the eccentric member is partially engaged with a central groove of a ring-like member.

Figure 6:
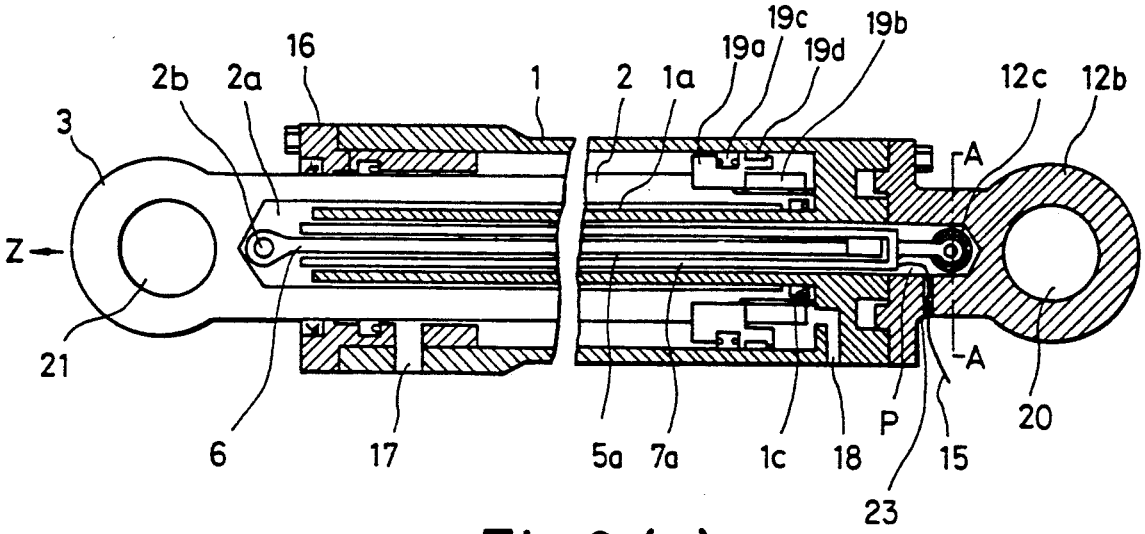
FIG. 6(*a*) and 6(*b*) are cross-sectional views of a cylinder with a built-in stroke sensor in accordance with a sixth embodiment of the present invention.
Figure 6:
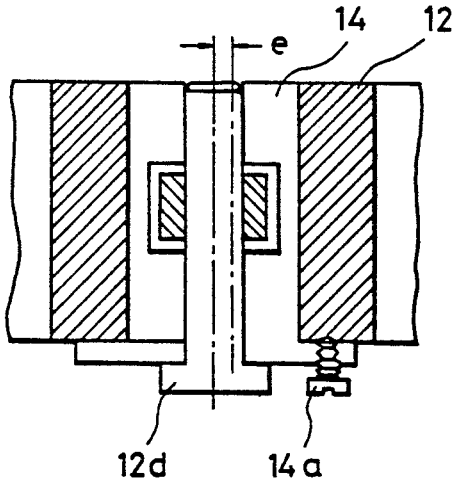
Figure 7:
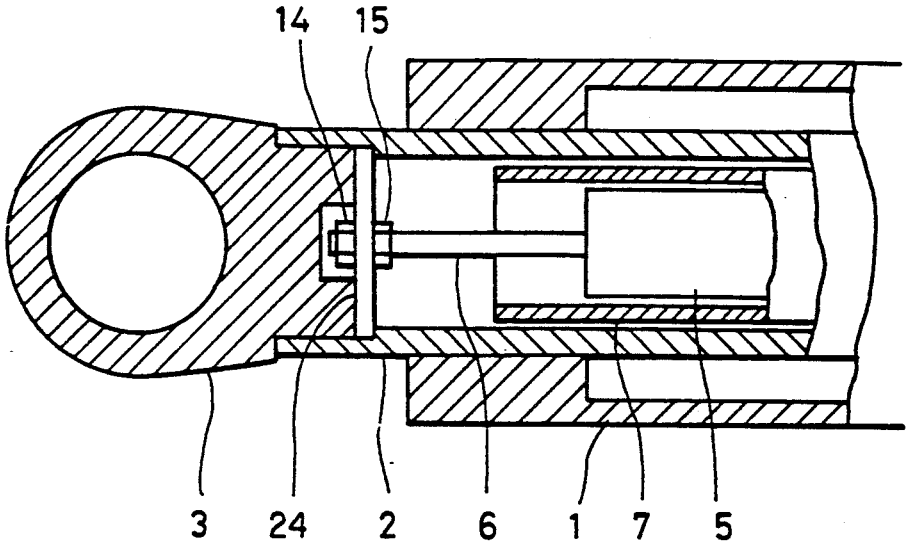
Fig 7 (PRIOR ART)
FIGS. 7 and 8 are cross-sectional views of head portions of cylinders with built-in stroke sensors in accordance with the prior art.
Figure 8:
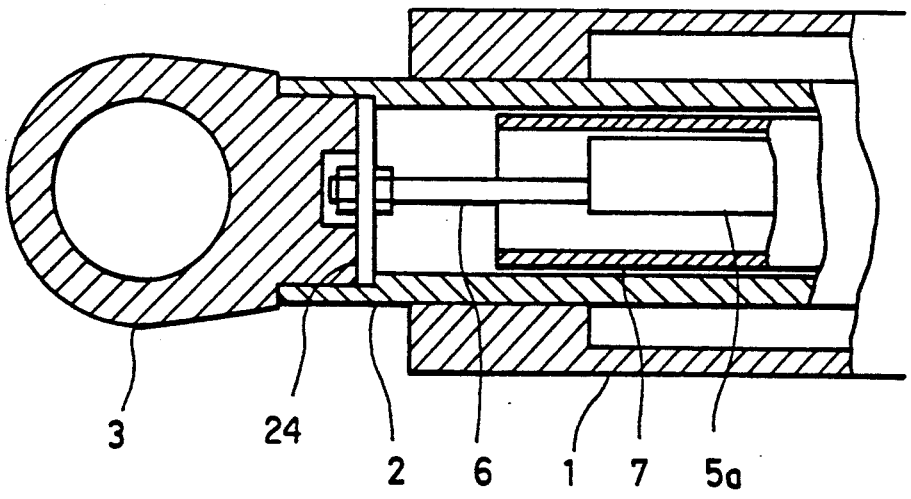
Fig 8 (PRIOR ART)

FIG. 6(*a*) and 6(*b*) show a sixth embodiment of the present invention in which a cylinder 1 is secured by a bottom 12*b* and bolts. A piston 19*a* is inserted in a piston rod 2 in the cylinder 1 and is fixed with nuts 19*b*. A packing 19*c* and a wear ring 19*d* are provided on the piston 19*a*, and the piston 19*a* is slidably fitted in the cylinder 1. The piston rod 2 is, on the rod head 3*f* side, loosely fitted in a sleeve fitted in a flange 16 fixed to the cylinder 1. A seal 1*c* is provided in a position as between an inside diameter of the piston rod 2 and an outside diameter of a tube 1*a* provided in the cylinder 1 to prevent the operating fluid from spattering on a sensor body 5*a* disposed in the tube 1*a*.

A sensor rod 6 at one end of the sensor body 5*a* constituted by a potentiometer or the like is engaged with and held by a pin 2*b* on an inner end portion of the piston rod 2, and a sensor accommodation tube 7*a* at the other end is engaged with and held by a pin 12*d* on an inner end portion 12*c* of the bottom 12 through a sleeve 14 having an eccentricity (e). The sleeve 14 is fixed on the bottom 12 by a fixing bolt 14*a* such as a screw after adjustment of the zero point of the sensor body 5*a*.

A wiring 15 is connected to the sensor accommodation tube 7*a* and is led to the outside through a hole 23 in the bottom 12.

Operating fluid supply/exhaust ports 17, 18 are formed in the cylinder 1.

The cylinder 1 is attached to an unillustrated construction machine or the like through a pin hole 20 formed in the bottom 12*b* and a pin hole 21 formed at one end of the piston rod 2.

When, in this arrangement, the operating fluid flows in through the supply/exhaust port 18, it forces out the piston 19*a* so that the piston rod 2 extends in the direction Z of FIG. 6(*a*). With this extension the sensor rod 6 connected by the pin 2*b* also extends. With this extension the voltage value of the sensor accommodation tube 7*a* electrically connected through the sensor body 5*a* is electrically detected to measure the length of the extension of the piston rod 2.

At this time, air flows into or out of the interior (P) of the bottom 12*b* through the hole 23. A supply/exhaust valve may be provided separately to enable air to flow in or out. If the variation in the capacity of the interior (P) is small or if there is a risk of an inflow of earth and sand or rain water, air supply/exhaust may be inhibited.

The adjustment of the sensor body 5*a* can also be effected by rotating the eccentric sleeve 14, and it is also possible to fix the potentiometer by a reamer with a structure similar to that of the pin 2*b*, to record voltages in a memory with respect to the state where the piston rod 2 is extended and the state where the piston rod 2 is fully contracted, and to effect linear interpolation therebetween at the time of measurement.

A potentiometer was used for the sensor body 5*a*, but it is not exclusive and other position detectors capable of detecting the absolute displacement may be used.

According to the present invention, as described above, the expansion/contraction motion of the stroke sensor can be effected with accuracy in accordance with the reciprocating motion of the piston rod 2. Also, the stroke sensor accommodation space can be minimized with respect to the rotation of the piston rod 2 irrespective of whether the stroke sensor is maintained in a stationary state or is smoothly rotated with the piston rod 2, thereby preventing the increase in the size of the fluid pressure cylinder and the increase in manufacture cost. It is also possible to improve the compatibility with fluid pressure cylinders having no built-in stroke sensor.

Further, there is no risk of the operating fluid leaking out at the time of inspection or replacement of the stroke sensor, and the facility with which inspection or replacement is effected is improved.

Industrial Applicability

The present invention is suitable for a cylinder with a built-in stroke sensor mounted in a construction machine or apparatus such as a construction machine used in a severe environment, and is particularly useful as a cylinder with a built-in stroke sensor in which the stroke sensor accommodation space is small and which is improved in the facility with which the stroke sensor is inspected or replaced.

What is claimed is:

1. A fluid pressure cylinder with a built-in stroke sensor including a cylinder having a bottom member at one of its ends, a tubular piston rod reciprocatively movable in said cylinder and having a rod head at one of its ends, and said stroke sensor being constituted by a sensor body and a sensor rod provided in the cavity of said piston rod, said fluid pressure cylinder with the stroke sensor being characterized in that an eccentric member is attached to a first end of said sensor rod, a recess/projection coaxial with said sensor rod is provided at the center of said eccentric member, a projection/recess axially supported by a recess/projection provided at the center of an end surface of said rod head is provided at an end of said eccentric member, and a ring-like member engaging with said recess/projection of said eccentric member is mounted in the cavity of said piston rod.

2. A fluid pressure cylinder with a built-in stroke sensor including a cylinder having a bottom member at one of its ends, a tubular piston rod reciprocatively movable in said cylinder and having a rod head at one of its ends, and said stroke sensor being constituted by a sensor body and a sensor rod provided in the cavity of said piston rod, said fluid pressure cylinder with the stroke sensor being characterized in that an eccentric member is attached to an end of said sensor rod, a recess/projection coaxial with said sensor rod is provided at the center of said eccentric member, a projection/recess axially supported by a recess/projection provided at the center of an end surface of said bottom member is provided at an end of said eccentric member, and a ring-like member engaging with said recess/projection of said eccentric member is mounted in the cavity of said cylinder.

3. A fluid pressure cylinder with a built-in stroke sensor including first and second tubular members, each of said first and second tubular members having a first end and a second end, said second tubular member being positioned within the cavity of said first tubular member with the first end of said first tubular member being adjacent the first end of said second tubular member, thereby forming an annular chamber between said first and second tubular members, an annular member joining the first end of said first tubular member to the first end of said second tubular member, said annular member and the first end of each of said first and second tubular members forming the first end of the pressure cylinder, a tubular piston rod having a first end and a second end with the first end of the tubular piston rod being slidably positioned in the chamber between said first and second tubular members for reciprocating motion therein and with the second end of the tubular piston rod extending beyond the second end of said second tubular member, said tubular piston rod having a rod head at the second end of the tubular piston rod, a first annular seal positioned between the outer surface of the tubular piston rod and the inner surface of the first tubular member to form first and second power chambers between said tubular piston rod and the inner surface of said first tubular piston rod and the inner surface of said first tubular member on either side of said first annular seal to receive operating fluid therein to reciprocate said piston rod, a bottom end removably attached to the first end of the pressure cylinder, a sensor accommodation tube positioned within the cavity of said second tubular member, a sensor rod having a sensor body thereon positioned within said sensor accommodation tube to thereby form said built-in stroke sensor, a first one of said sensor accommodation tube and said sensor rod being secured to said bottom end, the second one of said sensor accommodating tube and said sensor rod being secured to said tubular piston rod adjacent the second end thereof, a second annular seal positioned between the tubular piston rod and the second tubular member whereby said bottom end and said first one of said sensor accommodation tube and said sensor rod can be removed for inspection of the stroke sensor without leakage of the operating fluid from the first and second power chambers.

4. A fluid pressure cylinder in accordance with claim 3 wherein said second tubular member is positioned at least substantially coaxially with said first tubular member.

5. A fluid pressure cylinder in accordance with claim 4 wherein said tubular piston rod is positioned at least substantially coaxially with said second tubular member.

6. A fluid pressure cylinder with a built-in stroke sensor, comprising a first tubular member having a first end and a second end, a bottom member connected to said first end of said first tubular member, thereby forming a chamber within said first tubular member, a tubular piston rod having a first end and a second end, the first end of said tubular piston rod being slidably positioned within said chamber for reciprocating movement within said chamber, the second end of said tubular piston rod extending beyond the second end of said first tubular member, said tubular piston rod having a rod head at the second end of the tubular piston rod, a sensor rod having a sensor body eccentrically positioned thereon, said sensor rod and sensor body being positioned within the cavity of said tubular piston rod to thereby form said built-in stroke sensor, an eccentric member connected to one end of said sensor rod, one of said eccentric member and said rod head having an annular projection thereon with the other one of said eccentric member and said rod head having an annular recess therein for receiving said annular projection, the one of said annular projection and said annular recess which is part of said eccentric member being coaxial with respect to said sensor rod, one of said eccentric member and said rod head having a longitudinally extending projection thereon with the other one of said eccentric member and said rod head having a longitudinally extending recess therein for receiving said longitudinally extending projection, the one of said longitudinally extending projection and said longitudinally extending recess which is part of said rod head being coaxial with respect to said tubular piston rod, the one of said longitudinally extending projection and said longitudinally extending recess which is part of said eccentric member being eccentrically positioned with respect to said sensor rod.

7. A fluid pressure cylinder in accordance with claim 6 wherein the one of said annular projection and said annular recess which is part of said rod head is coaxial with respect to said tubular piston rod.

8. A fluid pressure cylinder in accordance with claim 7 wherein the longitudinally extending projection and the longitudinally extending recess support said sensor rod and sensor body for rotation about the longitudinal axis of said tubular piston rod.

9. A fluid pressure cylinder in accordance with claim 8 wherein the annular projection and the annular recess prevent significant longitudinal movement of said sensor rod with respect to said tubular piston rod.

10. A fluid pressure cylinder in accordance with claim 9 wherein said annular recess is in said eccentric member, and wherein said longitudinally extending recess is in said rod head.

11. A fluid pressure cylinder in accordance with claim 10 further comprising a sensor accommodation tube positioned within the cavity of said tubular piston rod, with said sensor body being positioned within the cavity of said sensor accommodation tube.

12. A fluid pressure cylinder in accordance with claim 9 wherein said annular recess is in said eccentric member, and wherein said longitudinally extending recess is in said eccentric member.

13. A fluid pressure cylinder in accordance with claim 12 further comprising a sensor accommodation tube positioned within the cavity of said tubular piston rod, with said sensor body being positioned within the cavity of said sensor accommodation tube.

14. A fluid pressure cylinder in accordance with claim 9 wherein said annular projection is on said eccentric member, and wherein said longitudinally extending recess is in said rod head.

15. A fluid pressure cylinder in accordance with claim 14 further comprising a sensor accommodation tube positioned within the cavity of said tubular piston rod, with said sensor body being positioned within the cavity of said sensor accommodation tube.

16. A fluid pressure cylinder in accordance with claim 9 wherein said annular projection is on said eccentric member, and wherein said longitudinally extending recess is in said eccentric member.

17. A fluid pressure cylinder in accordance with claim 16 further comprising a sensor accommodation tube positioned within the cavity of said tubular piston rod, with said sensor body being positioned within the cavity of said sensor accommodation tube.

18. A fluid pressure cylinder with a built-in stroke sensor, comprising a first tubular member having a first end and a second end, a bottom member connected to said first end of said first tubular member, thereby forming a chamber within said first tubular member, a tubular piston rod having a first end and a second end, the first end of said tubular piston rod being slidably positioned within said chamber for reciprocating movement within said chamber, the second end of said tubular piston rod extending beyond the second end of said first tubular member, said tubular piston rod having a rod head at the second end of the tubular piston rod, a sensor rod having a sensor body eccentrically positioned thereon, said sensor rod and sensor body being positioned within the cavity of said tubular piston rod to thereby form said built-in stroke sensor, an eccentric member connected to one end of said sensor rod, one of said eccentric member and said bottom member having an annular projection thereon with the other one of said eccentric member and said bottom member having an annular recess therein for receiving said annular projection, the one of said annular projection and said annular recess which is part of said eccentric member being coaxial with respect to said sensor rod, one of said eccentric member and said bottom member having a longitudinally extending projection thereon with the other one of said eccentric member and said bottom member having a longitudinally extending recess therein for receiving said longitudinally extending projection, the one of said longitudinally extending projecting and said longitudinally extending recess which is part of said bottom member being coaxial with respect to said tubular piston rod, the one of said longitudinally extending projection and said longitudinally extending recess which is part of said eccentric member being eccentrically positioned with respect to said sensor rod.

19. A fluid pressure cylinder in accordance with claim 18 wherein the one of said annular projection and said annular recess which is part of said bottom member is coaxial with respect to said tubular piston rod.

20. A fluid pressure cylinder in accordance with claim 19 wherein the longitudinally extending projection and the longitudinally extending recess support said sensor rod and sensor body for rotation about the longitudinal axis of said tubular piston rod.

21. A fluid pressure cylinder in accordance with claim 20 wherein the annular projection and the annular recess prevent significant longitudinal movement of said sensor rod with respect to said bottom member.

22. A fluid pressure cylinder in accordance with claim 21 wherein said annular recess is in said eccentric member, and wherein said longitudinally extending recess is in said bottom member.

23. A fluid pressure cylinder in accordance with claim 21 further comprising a sensor accommodation tube positioned within the cavity of said tubular piston rod, with said sensor body being positioned within the cavity of said sensor accommodation tube.

* * * * *